United States Patent [19]

Elberson et al.

[11] Patent Number: 4,792,092

[45] Date of Patent: Dec. 20, 1988

[54] PAINT COLOR CHANGE SYSTEM

[75] Inventors: Michael D. Elberson, Sylvania; Raymond G. Plummer, Toledo, both of Ohio

[73] Assignee: The DeVilbiss Company, Toledo, Ohio

[21] Appl. No.: 122,312

[22] Filed: Nov. 18, 1987

[51] Int. Cl.[4] ..... B05B 5/02; B05B 15/02; B05D 1/04; B05D 5/06

[52] U.S. Cl. ..... 239/3; 239/112; 239/691; 239/708; 239/305; 427/27

[58] Field of Search ..... 239/3, 112, 305, 574, 239/691, 708; 427/27, 421

[56] References Cited

U.S. PATENT DOCUMENTS

| | | | |
|---|---|---|---|
| 3,674,205 | 7/1972 | Kock | 239/1 |
| 4,017,029 | 4/1977 | Walberg | 239/691 X |
| 4,232,055 | 11/1980 | Shaffer | 427/33 |
| 4,337,282 | 6/1982 | Springer | 427/421 |
| 4,375,865 | 3/1983 | Springer | 222/135 |
| 4,383,644 | 5/1983 | Spanjersberg | 239/3 |
| 4,728,033 | 3/1988 | Matsumra | 239/112 X |

*Primary Examiner*—Andres Kashnikow
*Assistant Examiner*—Patrick N. Burkhart
*Attorney, Agent, or Firm*—MacMillan, Sobanski & Todd

[57] ABSTRACT

A paint color change system and method for sequentially supplying different color electrically conductive paints to an electrostatic applicator. Paint is supplied through a supply hose to a first isolated reservoir and the supply hose is purged and dried to form a voltage block. While paint is supplied through a first delivery hose from the first reservoir to an applicator, a second reservoir is cleaned, paint is supplied to the second reservoir through a supply hose, and the supply hose is purged of paint and dried to form a voltage block. Upon completion of coating with the first color paint, the first delivery hose is purged of paint and dried to form a voltage block and paint then is supplied from the second reservoir through a second delivery hose to the coating applicator. If the same color paint is applied from both reservoirs, the first delivery hose can be cleaned and dried after paint delivery from the second reservoir has started to permit continuous coating.

13 Claims, 2 Drawing Sheets

PAINT COLOR CHANGE SYSTEM

TECHNICAL FIELD

The invention relates to paint color change systems and more particularly to an improved color change system and method capable of rapid sequential application of different color water based paints and other electrically conductive liquids with an electrostatic applicator.

BACKGROUND ART

In manufacturing production lines, it often is desirable to have a paint system capable of painting successive workpieces, such as automobile bodies moving on a conveyor, different colors as they are conveyed past a spray station. As a consequence, both manual and automatic systems have been developed for changing color as successive workpieces are painted. In many applications, it also is desirable to use an electrostatic coating applicator which imparts a high voltage charge to the paint as it is atomized. Electrostatic spray painting has many advantages including producing a more uniform coating on irregular surfaces and reducing the amount of paint needed to coat a workpiece through an increased coating material transfer efficiency.

In recent years, there has been an increased desire to use water based paints whenever possible. Using water as the paint solvent is less expensive than other solvents and water is not harmful to the environment. Many problems have occurred in attempting to combine a color change system with an electrostatic coating system when an electrically conductive paint is used. When a water based paint or other electrically conductive liquid is applied with an electrostatic system, it is necessary either to totally isolate the paint supply from electrical ground or to provide a voltage block between the paint supply and the coating applicator. For a system of the first type capable of applying different color paints, supplies for all paints must be isolated from ground. Typically, all of the paint supplies will be at a high voltage during painting and color change.

Such a system has several disadvantages. A system of this type may be dangerous to personnel working in the area. A very large mass will be charged to a high voltage. This high electrical load is often sufficient to prevent the high voltage power supply from maintaining a desired voltage at the spray gun. The high electrical capacitance of the charged mass will result in a dangerously high quantity of electrical energy being stored in the system. Also, where the system permits all of the paint to be charged from the spray gun back to their source, it is not possible to perform maintenance work on any portion of the system while the spray gun is in operation. For example, while the system is painting workpieces with red paint, it is not possible to fill a different color tank, such as a green paint tank, with additional paint.

In a typical system using a voltage block for isolation, the voltage block is achieved by dripping individual droplets of the paint into a reservoir which is isolated from ground and supplying paint from the isolated reservoir to the coating applicator. Due to the conductivity of the paint, the reservoir will be at the same high voltage as the applicator. The individual droplets of paint break the circuit continuity between the grounded supply tanks and the reservoir. This arrangement is not easily cleaned for sequentially applying different color paint and is not suitable for rapid color change. In order to decrease the time required for color change, some systems provide a separate isolated reservoir for each color paint, as illustrated in U.S. Pat. No. 4,085,892, for example. Each of these reservoirs remains at the high voltage during painting and color change.

In a voltage block system shown in U.S. Pat. No. 4,232,055, different color electrically conductive paints are supplied from tanks which are individually isolated from ground and from each other. Each tank is located in a separate grounded cage. The tanks are connected through insulated hoses to a color change manifold. Only the tank currently supplying paint through the manifold to the electrostatic applicator will be charged to a high voltage due to the conductivity of the paint. Maintenance may be performed on any of the other paint tanks which are individually grounded when the cage enclosing each tank is opened. When painting with a selected color is completed, paint is purged from the insulated supply hose and the hose is dried to form a voltage block. This system still requires charging a relatively large mass to the same voltage to which the atomized paint is charged. Also, color change is delayed by the time required to purge and dry relatively long paint supply hoses connected to the supply tanks.

DISCLOSURE OF INVENTION

The present invention is directed to an improved color change system for supplying electrically conductive paint to an electrostatic applicator and to the method by which the system operates. Grounded pressurized paint sources are connected through a color selection manifold and electrically insulated supply hoses to two small capacity reservoirs. The reservoirs are insulated from ground and from each other. A predetermined quantity of paint required to coat a workpiece is supplied to a first of the reservoirs and the supply hose is purged from paint and dried to form a voltage barrier between the first reservoir and ground. While the first reservoir supplies paint to the coating applicator through an insulated hose, the second reservoir is cleaned and charged with a predetermined quantity and color of paint required to coat the next workpiece. Upon completion of coating from the first reservoir, the hose connecting the first reservoir to the coating applicator is cleaned and dried to form a voltage barrier. The next color paint is ready for immediate delivery from the second reservoir to the coating applicator. While the second color paint is supplied to the applicator, paint is purged from the first reservoir and the first reservoir is charged with a predetermined quantity of the next color paint to be applied to the next workpiece. During coating, only the coating applicator and paint from the supplying reservoir to the applicator will be charged. Therefore, the charged mass is reduced over prior art color change systems for conductive paints. During color change, only the hose between the spray gun, or a spray gun manifold, and the reservoir which last supplied paint need be purged and dried to form a voltage barrier between the gun and that reservoir. This reduces the time required for color change over prior art systems.

Accordingly, it is a preferred object of the invention to provide an improved color change system for applying electrically conductive paints in an electrostatic coating system.

Another object of the invention is to provide an improved color change system for supplying electrically conductive paints to an electrostatic applicator in which a relatively small mass is charged to a high voltage.

Still another object of the invention is to provide an improved color change system for supplying different colors of electrically conductive paint in rapid succession to an electrostatic applicator.

Other objects and advantages of the invention will be apparent from the following detailed description and the accompanying drawings.

BEST MODE FOR CARRYING OUT THE INVENTION

Figure 1:
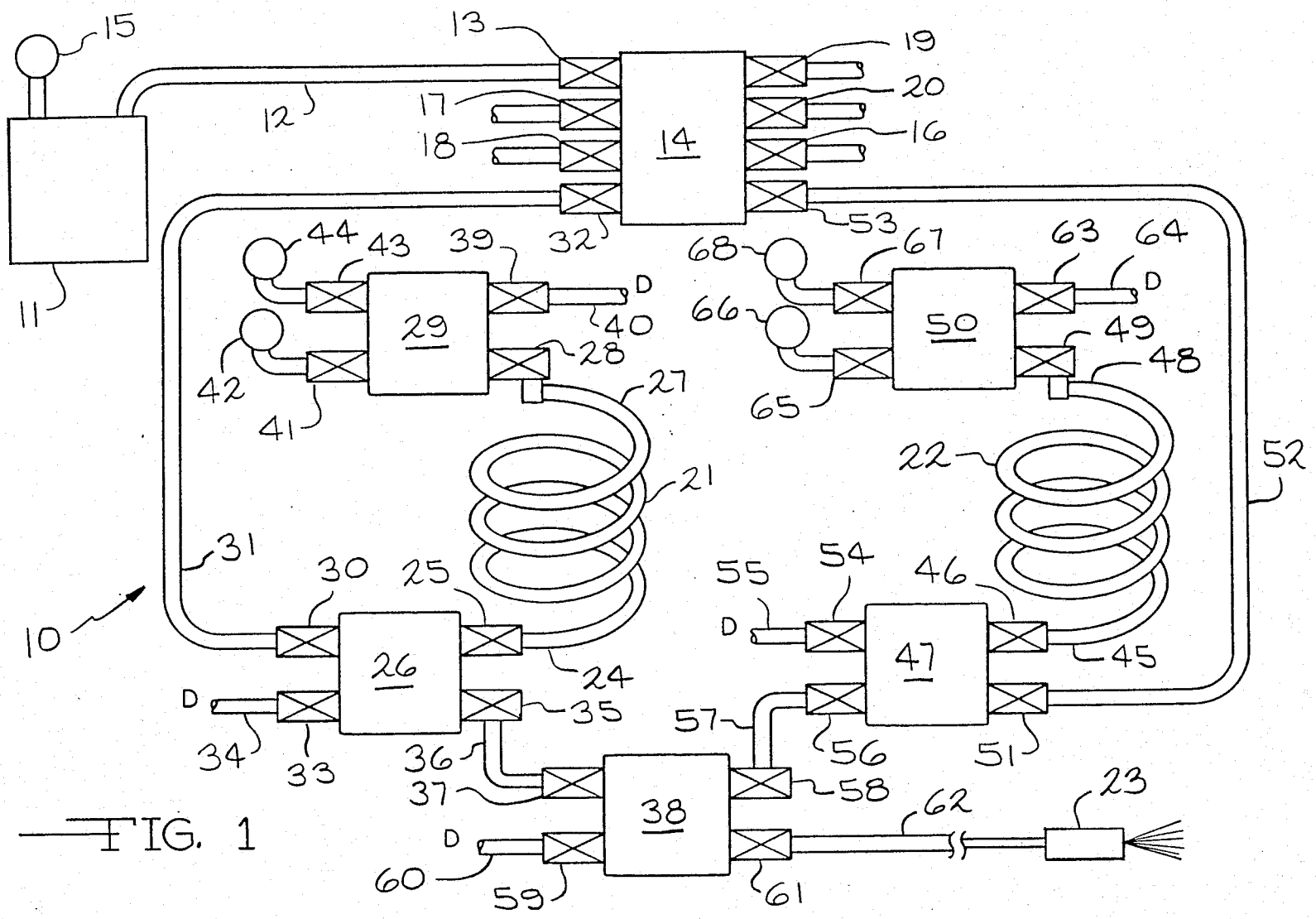
FIG. 1 is a diagrammatic block diagram of a color change system suitable for supplying an electrically conductive paint to electrostatic coating apparatus according to a first embodiment of the invention.

Turning to FIG. 1 of the drawings, a schematic block diagram of a paint color change system 10 capable of use with electrically conductive paints such as water based paints is shown according to a first embodiment of the invention. A paint source, such as a tank 11, is connected through a hose 12 to a valve 13 on a color selection manifold 14. The tank 11 may be sealed and a source of compressed air 15 may be connected to the tank 11 to cause paint to flow from the tank 11 to the manifold 14 when the valve 13 is opened. Or, a pump (not shown) can be located in the hose 12 for causing paint to flow under pressure from the tank 11 to the manifold 14. Several other valves on the color selection manifold 14, valves 16, 17 and 18 are shown, are connected to pressurized sources (not shown) of other color paint. The manifold 14 also has a valve 19 connected to a source of solvent (not shown) and a valve 20 connected to a source of compressed air (not shown). When the paint is of the water based type, the solvent may be water. All of the paint sources and the color selection manifold 14 are always at ground potential.

During coating of a workpiece, paint is delivered from one of two tubular fluid reservoirs 21 or 22 to an electrostatic spray gun 23. Typically, the spray gun 23 is located in a spray booth and is mounted on a reciprocator or on a program controlled industrial robot for movement along a desired path, or it may be mounted on a stationary stand. The reservoirs 21 and 22 preferably are each in the form of an electrically insulated tube arranged in a vertical helical coil. The internal diameter of the tube and the length of the tube preferably are selected to hold at least the volume of paint required to coat the largest workpiece to be coated by the system 10. Although tanks may be used for the reservoirs 21 and 22, using tubes for the reservoirs 21 and 22 has several advantages over the use of tanks. Less coating material will remain in the tube upon completion of a coating cycle and the tube is more readily purged of paint and dried during a color change cycle.

The reservoir tube 21 has a lower end 24 connected to a valve 25 on a first mode selection manifold 26 and has an upper end 27 connected to a valve 28 on a second mode selection manifold 29. The first mode selection manifold 26 also has a valve 30 connected through a hose 31 to a valve 32 on the color selection manifold 14, a valve 33 connected through a hose 34 to a suitable waste dump container (not shown) and a valve 35 connected through a hose 36 to a valve 37 on a coil selection manifold 38. The second mode selection manifold 29 also has a valve 39 connected through a hose 40 to the dump container, a valve 41 connected to a vent 42 and a valve 43 connected to a compressed air source 44.

The reservoir tube 22 is similarly arranged, having a lower end 45 connected to a valve 46 on a first mode selection manifold 47 and an upper end 48 connected to a valve 49 on a second mode selection manifold 50. The first mode selection manifold 47 also is connected through a valve 51 and a hose 52 to a valve 53 on the color selection manifold 14, is connected through a valve 54 and a hose 55 to the dump container and is connected through a valve 56 and a hose 57 to a valve 58 on the coil selection manifold 38. The coil selection manifold 38 is connected through a valve 59 and a hose 60 to the dump container and is connected through a valve 61 and a hose 62 to the spray gun 23. The second mode selection manifold 50 is connected through a valve 63 and a hose 64 to the dump container, through a valve 65 to a vent 66 and through a valve 67 to a compressed air source 68.

Voltage isolation between the first mode selection manifolds 26 and 47 and the grounded color selection manifold 14 is achieved by using electrically insulated hoses 31 and 52, respectively, to form voltage blocks between the manifolds 26 and 47 and the color selection manifold 14. Voltage isolation between the reservoir tubes 21 and 22 and between the reservoir tubes 21 and 22 and the spray gun 23 is achieved by the hoses 36 and 57 between the first mode selection manifolds 26 and 47, respectively, and the coil selection manifold 38. Also, all of the hoses 34, 40, 55, 60 and 64 connected to the dump container are made from an electrically insulated material. An electrical connection is present through a hose only so long as an electrically conductive liquid is present in a hose. A voltage barrier or block will be present across a hose whenever paint is purged from such hose and the hose is dried.

The system 10 is operated under the control of a conventional programmable controller (not shown) which is programmed to control the operating sequence and open times for the various valves and to operate a trigger valve in the spray gun 23. In operation, all hoses in the system 10 between the color selection manifold 14 and the spray gun 23 initially will be clean and dry. One of the color valves on the manifold 14, valve 13, for example, and one of the coil selection valves, valve 32, for example, will be opened to connect the pressurized paint source 11 to the hose 31. The valves 30 and 25 on the first mode selection manifold 26 will be opened to complete the connection from the source 11 to the lower reservoir end 24. At the same time, the valve 41 is opened to vent the upper end 27 of the reservoir tube 21. The valves remain open until a desired quantity of paint flows into the reservoir tube 21, whereupon the valves 13 and 25 are closed. The valve 13 may be closed when the paint remaining in the hose 31 is sufficient to complete the desired quantity of paint and the air valve 20 is opened to provide air pressure to push the remaining paint from the hose 31 into the reservoir tube 21. After the valve 25 is closed, the dump valve 33 is opened and the solvent valve 19 and the air valve 20 are pulsed to scrub the interior of the hose 31. The air valve 20 remains open after the solvent valve 19 is closed to dry the inside of the hose 31 to reestablish a voltage block along the length of the hose 31.

At this time, the reservoir tube 21 is charged with a predetermined quantity of paint. The vent valve 41 is closed and the valves 43 and 28 are opened to apply air pressure to the upper reservoir tube end 27. To start painting, the valves 25, 35, 37 and 61 are opened. When the spray gun 23 is triggered on, pressurized paint flows from the reservoir tube 21 through the manifold 26, the hose 36, the manifold 38 and the hose 62 to the spray gun 23. While paint is being applied by the spray gun 23, the reservoir tube 22 is charged with the next color paint. This is achieved by opening one of the paint selection valves 13, 16, 17 or 18 and the valve 53 on the color selection manifold 14, opening the valves 51 and 46 on the first mode selection manifold 47 and opening the valve 49 and the vent valve 65 on the second mode selection valve 50. Paint will flow from the selected source through the hose 52 into the lower reservoir tube end 45, while the upper reservoir tube end 48 is vented. When the desired quantity of paint is in the reservoir tube 22, the paint selection valve 13, 16, 17 or 18 and the valve 46 are closed and the dump valve 55 is opened. The solvent valve 19 and the air valve 20 are pulsed to clean and dry the interior of the hose 52. While the reservoir tube 22 is filled and the hose 52 is purged, the hose 57 forms a voltage block between the coil selection manifold 38, which will be at a high voltage, and the first mode selection valve 47, which will be grounded through the paint during filling and through the solvent during cleaning.

Upon completion of spraying with paint from the reservoir tube 21, the high voltage at the spray gun 23 is interrupted, the valves 32, 30, 35, 37 and 59 are opened and the solvent valve 19 and the air valve 20 are pulsed to clean and dry the hose 36 and the manifold 38 and the valve 61 is opened to clean and dry the hose 62 and the gun 23. At this time, the hose 36 will form a voltage block between the first mode selection manifold 26 and the coil selection manifold 38. The valves 35 and 37 are closed, the valves 25, 28 and 39 are opened, and the solvent and air valves 19 and 20 are pulsed to clean and dry the reservoir tube 21. The reservoir tube 21 then is filled with a predetermined quantity of the next color paint. While the reservoir tube 21 is cleaned, dried and charged with the next color paint, the valves 67 and 49 are opened to pressurize the reservoir tube 22 and the valves 46, 56, 58 and 61 are opened to deliver paint from the reservoir tube 22 to the spray gun 23. Thus, the system 10 is capable of providing a nearly constant flow of paint in a desired color sequence to the spray gun 23. Paint flow only need be interrupted while the voltage block hose 36 or 57, the coil selection manifold 38, the spray gun hose 62 and the spray gun 23 are cleaned and dried. No wait is required for cleaning the reservoir or for charging the reservoir with the next color paint. Also, it should be appreciated that the high voltage is present only at the spray gun 23 and on the column of paint extending from the spray gun 23 to the reservoir tube 21 or 22 currently supplying paint to the spray gun 23. This provides a significant safety factor since it minimizes the electrical capacity and accordingly the energy stored in the high voltage portion of the system and it maintains the paint supplies at ground potential to avoid risk to personnel working in the area.

Figure 2:
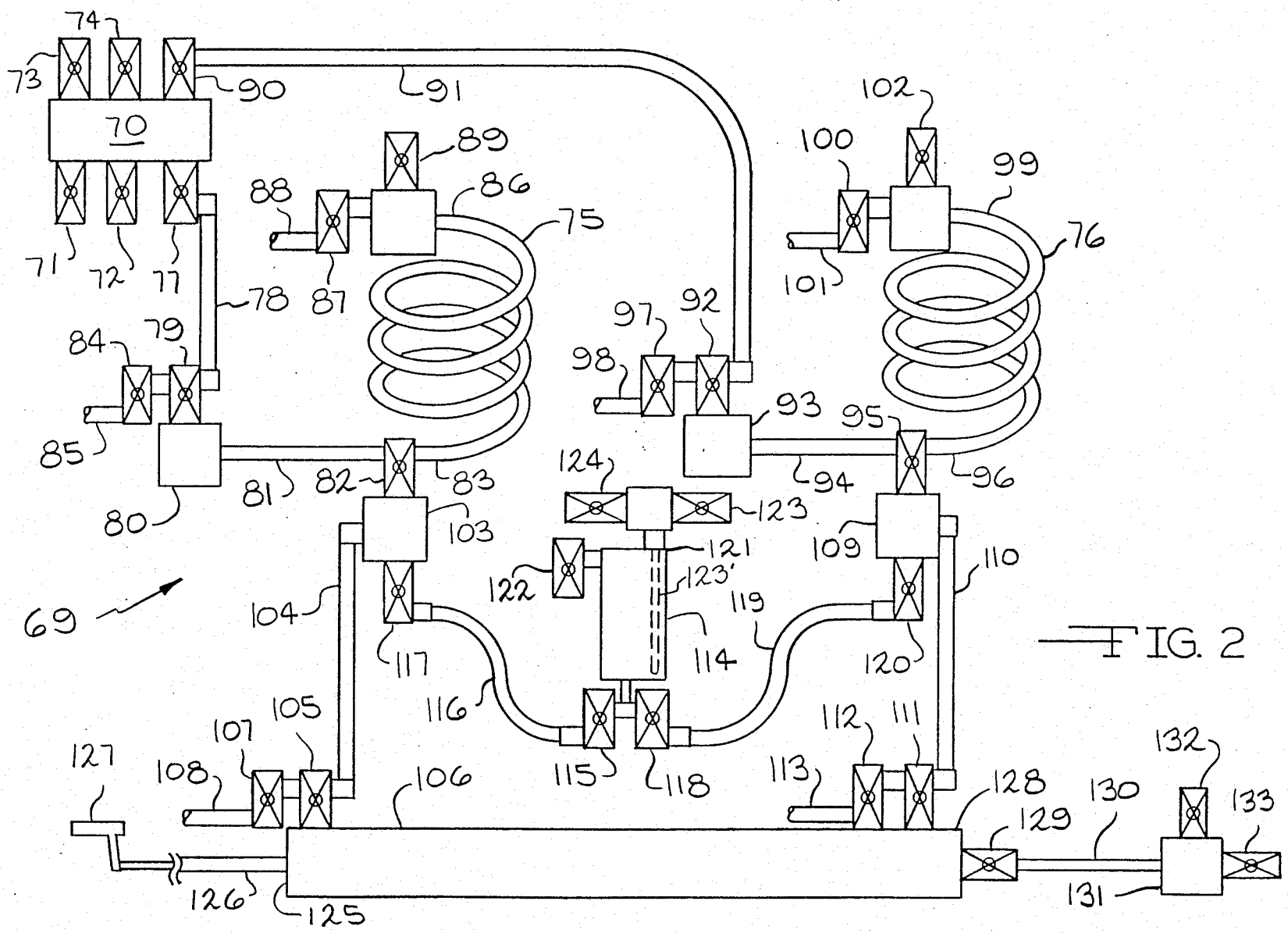
FIG. 2 is a diagrammatic block diagram of a color change system suitable for supplying an electrically conductive paint to electrostatic coating apparatus according to a second embodiment of the invention.

FIG. 2 shows a paint color change system 69 according to another embodiment of the invention. The system 69 includes a color selection manifold 70 having a plurality of valves, only two valves 71 and 72 are illustrated, connected to receive different color paint under pressure from suitable sources (not shown). The manifold 70 also includes a valve 73 connected to a pressurized solvent source (not shown) and a valve 74 connected to a source of compressed air (not shown). When the system is applying water based paint, the solvent source can be a commercial water supply. The manifold 70 is connected to selectively supply paint, solvent and air to either of two reservoir tubes 75 or 76. Preferably, the reservoir tubes 75 and 76 are in the form of vertically oriented closely wound helices. The size of the reservoir tubes 75 and 76 may be selected to hold the maximum quantity of paint required for a painting cycle on the largest workpiece to be coated by the system. Or, the reservoir tubes 75 and 76 may hold a lesser quantity and a single color paint can be applied on a continuous bases, flowing alternately from the two reservoir tubes 75 and 76.

The color selection manifold 70 is connected through a valve 77, a hose 78, a normally closed path in a two way valve 79 on a manifold 80, a hose 81 and a normally open path in a two way valve 82 to a lower end 83 of the reservoir tube 75. The hose 78 also is connected through a normally open path in the valve 79, a dump valve 84 and a hose 85 to a suitable dump container (not shown) which collects waste paint and solvent. The reservoir tube 75 has an upper end 86 which is connected through a dump valve 87 and a hose 88 to the waste container and is connected through an air valve 89 to a source of compressed air (not shown).

The color selection manifold 70 also is connected through a valve 90, a hose 91, a normally closed path in a two way valve 92 on a manifold 93, a hose 94 and a normally open path in a two way valve 95 to a lower end 96 of the reservoir tube 76. The hose 91 also is connected through a normally open path in the valve 92, a dump valve 97 and a hose 98 to the dump container. The reservoir tube 76 has an upper end 99 which is connected through a dump valve 100 and a hose 101 to the dump container and is connected through an air valve 102 to the source of compressed air.

The valve 82 at the lower reservoir tube end 83 is mounted on a manifold 103 which is connected through a hose 104 and a normally closed path in a two way valve 105 to a spray gun manifold 106. The hose 104 connects through a normally open path in the valve 105, through a dump valve 107 and a hose 108 to the dump container. The valve 95 at the lower reservoir tube end 96 is mounted on a manifold 109 which is connected through a hose 110 and a normally closed path in a two way valve 111 to the spray gun manifold 106. The hose 110 also connects through a normally open path in the valve 111 through a dump valve 112 and a hose 113 to the dump container. The bottom of a solvent isolation reservoir 114 is connected through a valve 115, a hose 116 and a valve 117 to the manifold 103 and is connected through a valve 118, a hose 119 and a valve 120 to the manifold 109. The solvent isolation reservoir 114 is connected at its top 121 to a vent valve 122, through a solvent valve 123 to a pressurized source of solvent and through an air valve 124 to the source of compressed air. The solvent valve 123 is connected to an insulated tube 123' which extends downwardly into the reservoir 114. The tube 123' prevents the solvent from splashing on the walls of the reservoir 114, and thereby prevents shorting of the valves 115 and 118 to the solvent valve 123.

The spray gun manifold 106 is connected at an end 125 through a gun hose 126 to an electrostatic spray gun 127. At an opposite end 128, the spray gun manifold 106 is connected through a valve 129 and a hose 130 to a manifold 131 which mounts an air valve 132 which connects to the source of compressed air and a solvent valve 133 which connects to the pressurized solvent source.

The system 69 is operated with the paint and solvent sources and the color selection manifold 70 always at ground potential. The reservoir tubes 75 and 76, the solvent isolation reservoir 114, the manifolds 80, 93, 103, 106 and 109 and the spray gun 127 are electrically insulated from ground. The hoses interconnecting these components as well as the various hoses connecting to the dump container and the hoses 78 and 91 connected to the color selection manifold 70 are all made of an electrically insulating material. Consequently, each hose forms a voltage block when it is clean and dry. During painting, all electrically conductive fluid in communication with the spray gun 127 will be at substantially the same high voltage as is present at the spray gun 127.

Prior to application of the first color paint by the spray gun 127, the reservoir tube 75 is initially cleaned and dried by pulsating the solvent valve 73 and the air valve 74 on the manifold 70 while the valve 77, the valve 79 and the dump valve 87 are actuated. At the same time, the solvent isolation reservoir 114 is partially filled with solvent, e.g., water, by opening the solvent valve 123 and the vent valve 122. The voltage block formed by the hose 104 is cleaned and dried by opening the air valve 124 to pressurize the reservoir 114 and opening the valves 115, 117 and 107. All of the solvent in the reservoir 114 flows through the hose 116 and is followed by dry compressed air which flows through the reservoir 114. After the hose 104 is cleaned and dried, the valves 115, 117 and 107 are closed and the reservoir 114 is again partially filled with solvent. The voltage block formed by the hose 110 now is cleaned and dried by opening the air valve 124 to pressurize the reservoir 114 and opening the valves 118, 120 and 112. While this takes place, the reservoir tube 75 is filled with paint by opening a paint valve, valve 71, for example, on the color selection manifold 70 and actuating the valves 77 and 79 to feed paint through the hoses 78 and 81 to the lower reservoir end 83. At the same time, the dump valve 87 is opened to vent the upper end 86 of the reservoir tube 75. The valves remain open until a predetermined quantity of paint is stored in the reservoir tube 75. The actual quantity of paint will depend upon the area to be coated and the application rate. After the reservoir tube 75 is filled, the hose 78 is cleaned and dried by opening the valve 77 and the dump valve 84 and operating the solvent valve 73 and the air valve 74 on the color selection manifold 70. During this startup phase prior to painting, the spray gun manifold 106, the hose 126 and the spray gun 127 also are cleaned and dried by opening the valve 129 and a trigger valve (not shown) in the spray gun 127 and operating the solvent valve 133 and the air valve 132.

At this time, the reservoir tube 75 is charged with paint, the voltage blocks are clean and dry and the system 69 is ready to begin painting. Painting is begun by turning on the high voltage to the spray gun 127, opening the air valve 89 to pressurize the reservoir tube 75, actuating the valves 82 and 105 and triggering the spray gun 127. Paint will flow to the spray gun until coating with the selected color is completed or the paint in the reservoir tube 75 is consumed. While painting is taking place, the reservoir tube 76 is charged with the next color paint, or with the same color paint if the next workpiece is to be coated the same color of if the workpiece being coated from the reservoir tube 75 requires a greater quantity of paint than will fit into the reservoir tube 75. Prior to filling, the reservoir tube 76 is cleaned and dried by actuating the valves 90 and 92 and operating the solvent valve 73 and the air valve 74 on the color selection manifold 70. The reservoir tube 76 then is filled by actuating the valves 90 and 92 and one of the paint valves, such as valve 72. At the same time, the solvent isolation reservoir 114 is partially filled with solvent by opening the valves 122 and 123. After the reservoir tube 76 is filled, the hose 91 is cleaned and dried to form a voltage block by opening the valves 90 and 97 and operating the solvent valve 73 and the air valve 74.

As soon as coating with fluid from the reservoir tube 75 is completed, the electrostatic power supply is turned off and the hose 104 is cleaned by opening the air valve 124 to pressurize the solvent isolation reservoir 114 and opening the valves 115, 117 and 107. At the same time, the spray gun manifold 106, the hose 126 and the spray gun 127 are cleaned and dried by opening the valve 129, opening the spray gun trigger valve and operating the solvent valve 133 and the air valve 132. In an exemplary system 69, the hose 104, the manifold 106, the gun hose 126 and the spray gun 127 were cleaned and dried in only 22 seconds. The system 69 then was immediately ready for coating with paint from the reservoir tube 76.

The cycle for coating from the reservoir tube 76 operates similar to the cycle for the reservoir tube 75. The air valve 102 is opened to pressurize the reservoir tube 76 and the valves 95 and 111 are actuated to cause fluid to flow from the reservoir tube 76 through the hose 110, the spray gun manifold 106 and the gun hose 126 to the spray gun 127. While fluid is flowing to the spray gun 127, the reservoir tube 75 is cleaned and dried, the solvent isolation reservoir 114 is partially filled and the reservoir tube 75 is filled with the next color paint to be applied to a workpiece. The hose 78 is cleaned and dried after the reservoir tube 75 is filled to form a voltage block between the reservoir tube 75 and the color selection manifold 70. The operating cycles for the system 69 are repeated, alternately filling the reservoir tube 76 while coating with paint from the reservoir tube 75 and filling the reservoir tube 75 while coating with paint from the reservoir tube 76.

The system 69 also can be operated to continuously coat with a single color paint. During a normal color change cycle, the high voltage is turned off. While power is off, the spray gun manifold 106, the hose 126, the spray gun 127 and the last used paint delivery hose 104 or 110 are cleaned and dried. These operations are unnecessary when coating continuously with a single color. When coating is completed with paint from the reservoir tube 75, paint delivery is immediately started from the reservoir tube 76. While coating continues, the hose 104 is cleaned with solvent from the solvent isolation reservoir 114. After a voltage block is reestablished between the reservoir tube 75 and the spray gun manifold 106, the reservoir tube 75 is refilled with paint and the hose 78 is cleaned and dried to reestablish the voltage block between the color selection manifold 70 and the reservoir tube 75. The same procedure takes place with the reservoir tube 76 after its paint supply is consumed and paint delivery is switched back to the reservoir tube 75.

From the above description, it will be appreciated that the color change system 69 provides a minimum down time for changing from one color paint to different color paint. The operation of the various valves for supplying paint to the spray gun 127 and the operation of the valves for cleaning and drying the various hoses and for filling the reservoirs can be controlled by a conventional programmable process controller. Various changes and modifications may be made to the described color change systems and the method by which the systems operate without departing from the spirit and the scope of the following claims.

We claim:

1. An electrically isolating color change system for supplying selected colors of electrically conductive liquid coating materials to an electrostatic coating applicator, comprising, a plurality of different coating material supplies, first and second electrically insulated material reservoirs, electrically insulated means for supplying a predetermined quantity of coating material from a selected one of said supplies to a selected one of said reservoirs, means for cleaning said supply means after material is supplied to a reservoir to form an electrical barrier between said supply means and such reservoir, means for pressurizing a reservoir containing coating material, electrically insulated means for delivering coating material under pressure from a pressurized reservoir to the coating applicator, means for cleaning the other of said reservoirs while coating material is delivered from such pressurized reservoir to the coating applicator, said material supplying means including means for supplying a predetermined quantity of coating material from a selected one of said supplies to such other reservoir while coating material is delivered from such pressurized reservoir to the coating applicator, and means for cleaning said delivery means upon completion of coating with material from such pressurized reservoir to form an electrical barrier between said pressurized reservoir and the coating applicator.

2. An electrically isolating color change system for supplying selected colors of electrically conductive liquid coating materials to an electrostatic coating applicator, as set forth in claim 1, wherein said first and second reservoirs comprise first and second helically coiled tubes each having a lower first end and an upper second end, wherein coating material is supplied to and delivered from said first ends of said reservoirs and wherein said means for pressurizing a reservoir containing coating material applies a compressed gas to the second end of such reservoir.

3. An electrically isolating color change system for supplying selected colors of electrically conductive liquid coating materials to an electrostatic coating applicator, as set forth in claim 2, wherein said means for supplying a predetermined quantity of coating material from a selected one of said supplies to a selected one of said reservoirs includes means for venting the second end of a selected reservoir while coating material is supplied to such selected reservoir.

4. An electrically isolating color change system for supplying selected colors of electrically conductive liquid coating materials to an electrostatic coating applicator, as set forth in claim 2, wherein said means for cleaning coating material from said supply means comprises means for circulating a coating material solvent through said supply means to clean coating material from said supply means, and means for passing a gas through said supply means to purge solvent from said supply means.

5. An electrically isolating color change system for supplying selected colors of electrically conductive liquid coating materials to an electrostatic coating applicator, as set forth in claim 2, wherein said means for cleaning material from the other of said reservoirs comprises means for flushing such other reservoir with a coating material solvent to purge coating material from such other reservoir, and means for passing a gas through such other reservoir to purge solvent from such other reservoir.

6. An electrically isolating color change system for supplying selected colors of electrically conductive liquid coating materials to an electrostatic coating applicator, as set forth in claim 1, wherein said means for supplying a predetermined quantity of coating material from a selected one of said supplies to a selected one of said reservoirs includes a manifold, a plurality of normally closed color selection valve means attached to said manifold, means connecting each coating material supply to a different one of said color selection valve means whereby coating material flows from a selected supply to the manifold when the connected valve means is opened, first valve means attached to said manifold, a first electrically insulating hose having a first end connected to said first valve means and a second end, means connecting said second end of said first hose to said first reservoir, whereby coating material flows from a supply to said first reservoir when a color selection valve means and said first valve means are opened, second valve means attached to said manifold, a second electrically insulating hose having a first end connected to said second valve means and a second end, and means connecting said second end of said second hose to said second reservoir whereby coating material flows from a supply to said second reservoir when a color selection valve means and said second valve means are opened.

7. An electrically isolating color change system for supplying selected colors of electrically conductive liquid coating materials to an electrostatic coating applicator, as set forth in claim 6, wherein said means for cleaning coating material from said supply means after material is supplied to a selected one of said reservoirs includes a normally closed solvent valve and a normally closed air valve attached to said manifold, a source of solvent under pressure, means connecting said source of solvent to said solvent valve, a source of compressed air, means connecting said source of compressed air to said air valve, wherein said means connecting said second end of said first hose to said first reservoir includes normally closed first dump valve means for connecting said second end of said first hose to a fluid dump when open while blocking material flow from said first reservoir, and wherein said means connecting said second end of said second hose to said second reservoir includes second dump valve means for connecting said second end of said second hose to a fluid dump when open while blocking material flow from said second reservoir.

8. An electrically isolating color change system for supplying selected colors of electrically conductive liquid coating materials to an electrostatic coating applicator, as set forth in claim 7, wherein said means for cleaning coating material from said delivery means upon completion of coating includes an electrically insulated solvent reservoir, means including an electrically insulating solvent hose for flushing coating material from at least a portion of said delivery means with solvent from said solvent reservoir, and means for drying solvent from said solvent hose and said portion of said delivery means to form electrical barriers between said material reservoirs, said coating applicator and said solvent reservoir.

9. An electrically isolating color change system for supplying selected colors of electrically conductive liquid coating materials to an electrostatic coating applicator, as set forth in claim 1, wherein said plurality of different coating material supplies are electrically grounded.

10. A method for selectively supplying different color electrically conductive coating material to an electrostatic coating applicator comprising the steps of:

(a) supplying a predetermined quantity of coating material from a grounded coating material supply through a first electrically insulating hose to a first reservoir;

(b) cleaning and drying said first hose to form a voltage block between such supply and said first reservoir;

(c) supplying coating material from said first reservoir through a second electrically insulating hose to the coating applicator;

(d) simultaneously with supplying coating material from said first reservoir to the coating applicator, supplying coating material from a grounded coating material supply through a third electrically insulating hose to a second reservoir;

(e) cleaning and drying said third hose to form a voltage block between such supply and said second reservoir; and (f) supplying coating material from said second reservoir through a fourth electrically insulating hose to the coating applicator.

11. A method for selectively supplying different color electrically conductive coating material to an electrostatic coating applicator, as set forth in claim 10, and further including the step of cleaning and drying said second hose to form a voltage block between said first reservoir and the coating applicator prior to supplying coating material from said second reservoir.

12. A method for selectively supplying different color electrically conductive coating material to an electrostatic coating applicator, as set forth in claim 11, and further including the step of supplying a predetermined quantity of coating material from a grounded coating material supply through said first hose to said first reservoir and then cleaning and drying said first hose to form a voltage block between such supply and said first reservoir simultaneously with supplying coating material from said second reservoir to the coating applicator.

13. A method for selectively supplying different color electrically conductive coating material to an electrostatic coating applicator, as set forth in claim 10, and, simultaneously with the step of supplying coating material from said second reservoir, further including the steps of cleaning and drying said second hose to form a voltage block between said first reservoir and the coating applicator, supplying a predetermined quantity of the same coating material as is being delivered from the second reservoir from its supply through said first hose to said first reservoir and then cleaning and drying said first hose to form a voltage block between such supply and said first reservoir.

* * * * *